US006098914A

United States Patent [19]

Badiali et al.

[11] Patent Number: 6,098,914

[45] Date of Patent: Aug. 8, 2000

[54] SYSTEM FOR MOVING SPOOLS AND TUBES IN AUTOMATIC SPOOLERS

[75] Inventors: Roberto Badiali; Gianni Santarossa, both of Pordenone; Luciano Bertoli, Fiume Veneto, all of Italy

[73] Assignee: Savio Macchine Tessili S.p.A., Pordenone, Italy

[21] Appl. No.: 09/282,977

[22] Filed: Mar. 31, 1999

[30] Foreign Application Priority Data

Mar. 31, 1998 [IT] Italy ..... MI98A0684

[51] Int. Cl.[7] ..... B65H 49/00

[52] U.S. Cl. ..... 242/474.1; 242/474.2; 242/474; 242/473.4

[58] Field of Search ..... 242/474.1, 474.2, 242/474, 473.4, 470

[56] References Cited

U.S. PATENT DOCUMENTS

| | | | |
|---|---|---|---|
| 4,605,177 | 8/1986 | Uchida et al. | 242/474.1 |
| 4,843,811 | 7/1989 | Yamamoto et al. | 242/474 X |
| 4,845,937 | 7/1989 | Kiriake et al. | 242/474 X |
| 5,172,541 | 12/1992 | Schmalz | 242/474 X |
| 5,308,001 | 5/1994 | Grecksch et al. | 242/474 |
| 5,365,728 | 11/1994 | Mack | 242/474 X |
| 5,402,951 | 4/1995 | Hermanns et al. | 242/470 |
| 5,443,165 | 8/1995 | Hasui . | |

FOREIGN PATENT DOCUMENTS

| | | |
|---|---|---|
| 0 855 016 A2 | 9/1998 | European Pat. Off. . |
| 197 17 564 A1 | 11/1997 | Germany . |

*Primary Examiner*—Donald P. Walsh
*Assistant Examiner*—Minh-Chau Pham
*Attorney, Agent, or Firm*—Kramer Levin Naftalis & Frankel LLP

[57] ABSTRACT

An improved system for moving the spools and tubes on the trays of automatic spoolers, where the spooling units composing the machine are at their outlet connected to a discharge circuit fitted with a switch capable of routing the trays on a return path, or switching them to a "stand-by" circulation on the circuit.

6 Claims, 4 Drawing Sheets

SYSTEM FOR MOVING SPOOLS AND TUBES IN AUTOMATIC SPOOLERS

FIELD OF THE INVENTION

This invention deals with a processing system for the winding or spooling of high-grade yarns.

BACKGROUND INFORMATION

Spooling is a much more productive operation than spinning, because the yarn is spooled at a much higher linear velocity than in spinning, so that a limited number of spooling stations is capable of handling the yarn produced in a large number of spinning stations, for instance in a circuit-type spinning system producing yarn wound on a very large number of small size spools; these are then handled in the spooler, whose yarn is unraveled, freed from its defects and rewound on a smaller number of spools of larger size.

The moving in a spooler covers not only the full spools supplied by the spinners to the spooler and the empty tubes returned by the spooler to the spinner to form new spools, but also the non negligible number of irregular spools.

These irregular spools are generally tubes from which the wound yarn has not been picked up completely and from which the spooling unit is unable to recover further yarn by its own means, for instance because it tails to catch the end of skein to resume the unraveling process. The re-use of these irregular spools thus requires them to be recycled to the spools' setting-up station to recover their ends of skein and set them up for their unreeling in the spinning process. In order to feed them to the spinning process, the spools must In fact be set up with their ends of skein in a predetermined position, for instance inserted into the tube on which it is wound. The spooling station is thus capable of catching the ends of skein independently, and to launch their automatic spooling process without the aid of operators.

In the spooling circuit the spinner requires a considerable circulation of material to be moved and controlled: the empty tubes to be returned to the spinning process to rewind them into spools, the new spools to be set up for feeding to the spooler, and of the unraveled spools to be recirculated. In spoolers of a recent design the overall movement involves thousands of spools per hour.

For this reason the moving and normal handling of the machines are entrusted as far as possible to automatic devices, and the action of operators is limited to supervising and handling of malfunctions.

A technical solution for moving the spools and tubes enjoying considerable favor, for instance according to the patent FR 1,571,158 or U.S. Pat. No. 4,403,909, consists in moving them on trays, which are generally formed by a disc fitted with a spool or tube holding pin, or a central vertical peg capable of holding them in an upright position resting against a collar of a diameter larger than the tube. In this position the spool is subjected to essentially all the operations designed for the machine.

This setup allows the spools to be transferred and handled while essentially avoiding any undesirable soiling contact with the parts of the machine. The vehicle constituted by the tray also turns out to be most useful for the simultaneous handling of multiple batches of different yarns during the spooling process, because the spools can be differentiated based on their carrying tray and the latter can be addressed to the spooling stations specifically dedicated to them, according to the batches of yarn being processed.

SUMMARY OF THE INVENTION

This invention refers to an improved system for the moving of full and empty spools by said tray-type supports.

DETAILED DESCRIPTION OF THE INVENTION

Figure 1:
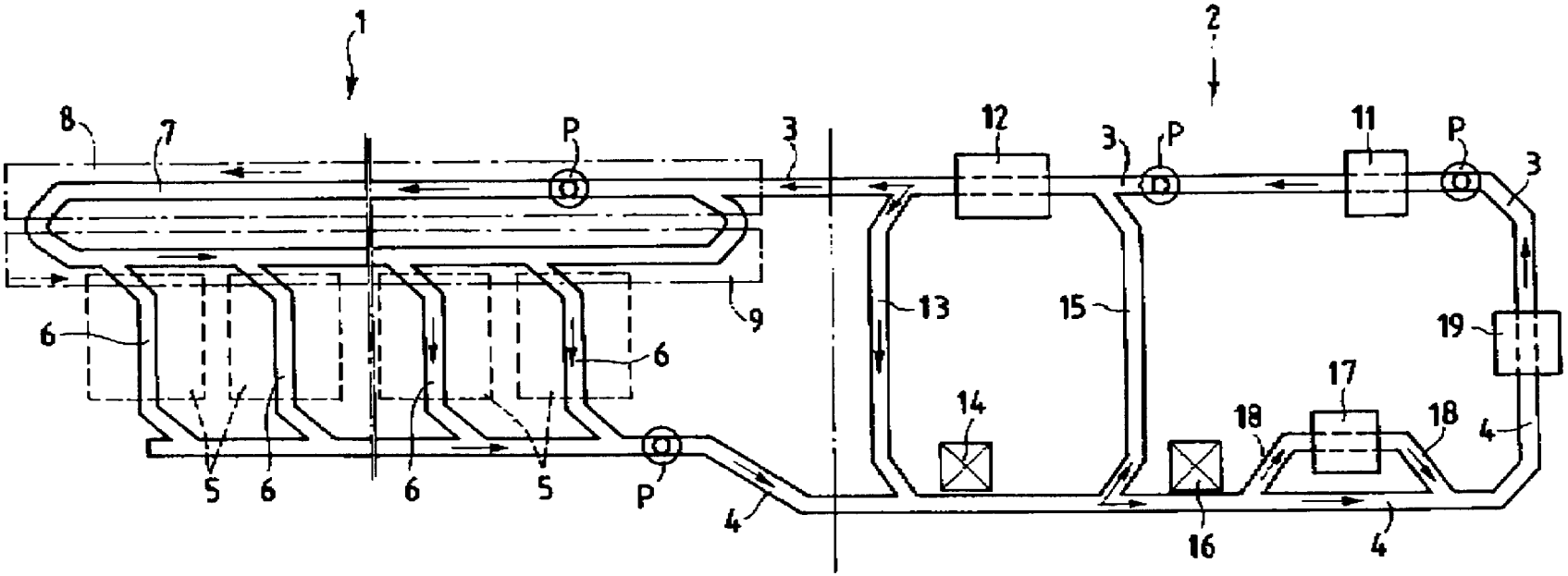
FIG. 1 is a plan view of a simplified setup for the layout of a spooling machine.
Figure 2:
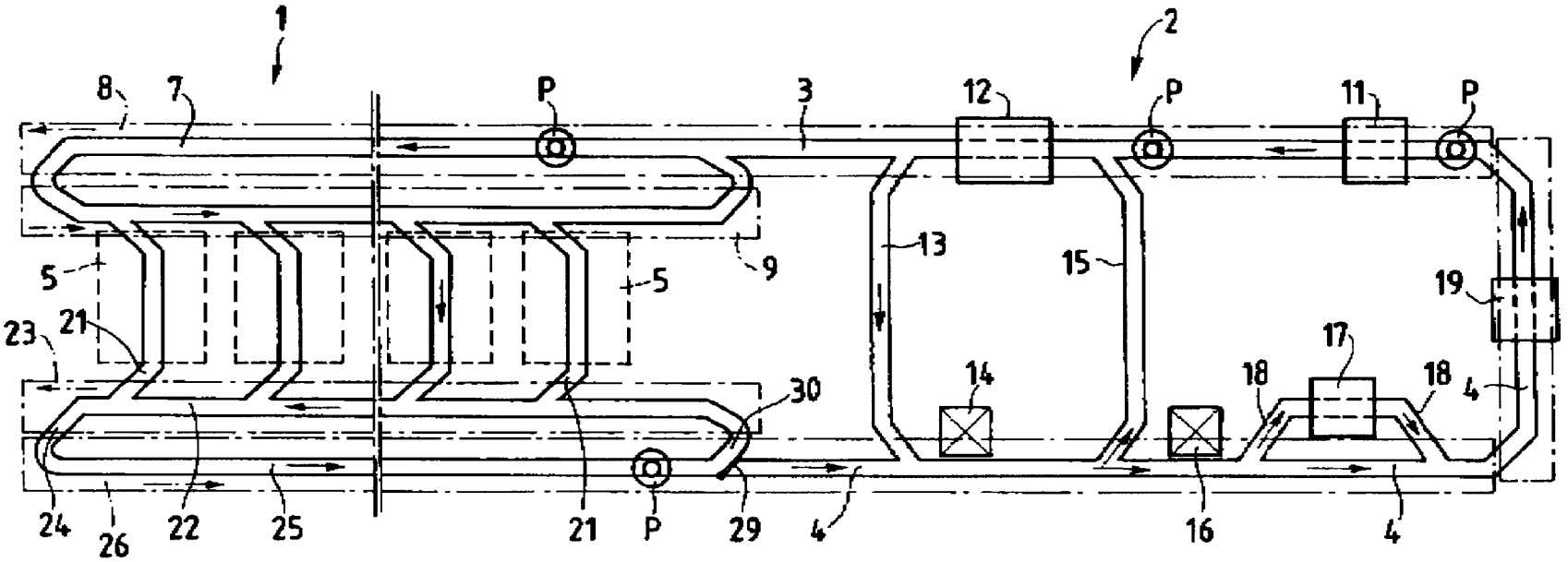
FIG. 2 depicts the layout of a spooling machine according to an embodiment of the present invention.

In order to better evidence the characteristics and advantages of this invention, it will now be described with reference to a typical embodiment illustrated in the FIGS. from 2 to 4 for exemplifying but not limiting purposes, while FIG. 1 represents the spooler's reference layout.

FIG. 1 offers a plan view of a simplified setup of an exemplifying embodiment of the layout of a spooling machine.

According to the layout of FIG. 1, the spooling machine can be divided into a section 1 for the spooling and a section 2 for the setting-up of the spools. Between these sections there is a circulation of spool carrying trays P, which may from case to case carry a new spool or a tube still containing a significant length of yarn to be re-used, or the tube of a completely unreeled spool, or finally a soiled tube, containing a negligible residual amount of yarn to be removed, This circulation is assured by transport systems already known in the art. They may for instance consist in conveyor belts, rotating plates or small belts supporting and communicating their motion to the trays, coupled with laterally orienting guides capable of contacting the base of the trays, generally their collars. A different arrangement may be set up by placing the trays on smooth planar surfaces, causing them to slide along the same by pushing and orienting organs set up on their side, for instance according to the European patent EP-A-721910 in the name of the same applicant. The embodiment of FIG. 1 shows the systems based on a conveyor belt or small belt with overlaying orienting guides, which serve as main transporting paths 3 and 4, for the incoming of the spools destined to be spooled and the outgoing of the totally or partially exhausted spools coming from the spooling process, respectively.

The spooling section 1 is constituted by a series of spooling units 5 in which the spools move between stand-by, unraveling and unloading positions according to an internal path 6, which connects the spool feeding circuit 7 to the unloading line 4 for the partially or totally exhausted spools. Inside each spooling unit 5 the spools are moved and precisely positioned by levering systems already known in the art, for instance according to the European patent application EP-A-721909 in the name of the same applicant.

In the embodiment shown in FIG. 1, the feeding circuit 7 may for instance be produced with a pair of conveyor belts a and 9, as shown by a dotted line in the figure, one running to the left and the other to the right and connected by curved portions of their lateral guides; alternatively, it may be produced by the dragging of resting surfaces by pushing and guiding means according to the European patent application EF-A-721910. Said feeding circuit 7 upholds the circulation of a multiple number of spools, each carried on its spool holding tray and ready to be used in the spooling unit 5. As soon as one of these units has unloaded a tray P with an exhausted spool on the return path 4, it may pick up from circuit 7 a tray P carrying a new spool held in the spooling unit in a stand-by position, and therefore carried to the unraveling process, by spooling-up the yarn wound on its tube.

The section 2 involving the setting-up of the yarn comprises the handling units of the spools and tubes auxiliary to the spooling process.

This section comprises a spool loading unit 11, which receives the unloaded trays P coming in from their return path and loads them up with new spools. In case several batches of yarn are processed simultaneously, such a loading unit may be composed of several loading stations, each of which releases a spool from its own batch of yarn, while identifying while receiving tray on a case-to-case basis.

In the setting-up section 2 the trays loaded up with the new spools move on to the transport line 3 toward the spool setting-up unit 12. Before being slipped onto the tray to be moved to the spooling process, the spools are deprived of the so-called subspool; in the setting-up station 12 the end of skein of the yarn wound up on the same is caught, picked up, cut to a controlled length and introduced in the upper opening of the tube, from which it will be picked up at the start of its unreeling step on the unit 5. Before releasing the spool from its setting-up station 12, the favorable outcome of its setting-up process is controlled by appropriate sensors. If this control is positive, the tray of the spool is conveyed along the path 3 toward the circuit 7. If on the other hand the control reveals that the setting-up of the spools failed to have a favorable outcome and to properly insert its end of skein into the tube, its tray is switched over—by a switch not shown in the figure to the recycling path 13 that takes these trays to the return path 4. Even the setting-up unit 12 may be split up among several setting-up stations. This splitting may be appropriate and even necessary for various reasons. It is in any case necessary if the number of set-ups per hour exceeds the capacity of a Single unit, or the processing simultaneously involves several yarns, each requiring an appropriate setting-up procedure. The splitting further affords potential some extra margins which are useful both in the early stages of launching a campaign, as reserve units in the case of problems, and where low or uneven-grade yarns are to be processed.

The return path 4 simultaneously includes trays coming from the spooling section 1 and carrying either incomplete spools A to be recycled, tubes B of exhausted spools, tubes C with residual yarn to be removed, which are correctly termed soiled tubes, and trays coming directly from unit 12 and carrying spools whose setting up has not been successful and which are to be recycled like the spools A.

All these trays moving on the return path 4 are controlled in a selection station 14 which identifies the spools of type A and thus determines the switching on their trays P—using switches of a known type, not shown in the figure for simplicity—to the path 15 that leads them to rejoin each other directly on path 3, just upstream of the setting-up unit 12. This identification is generally carried out by sensing, or measuring by optic means, of the diameter of the base of the yarn wound-up on the tube. If this diameter exceeds a predetermined size, the spool is of type A, and the tray of this spool is moved to be recycled on path 15.

On the other hand, the trays carrying clean or "soiled" tubes due to yarn residues continue moving along their path 4 and meet a further selecting station 16 capable of identifying the tubes C, which are therefore switched again on their trays—using switches of a known type, not shown in the figure for simplicity—toward a tube cleaning unit 17 placed on the path 18, for instance a cleaning device according to the Italian patent application MI96A001608 in the name of the same applicant.

The identification of the soiled tube is generally done by controlling its surface characteristics by sensing; for example, the tube is identified as being "soiled", if it offers a sufficient grasp to a dented sensor.

The trays with cleaned tubes in the unit 17 continue on their path 18 and re-enter the path 4, where they re-join the trays carrying the already cleaned tubes B, because they have been completely exhausted by the spooling in the units 5.

The path 4 continues toward the tube unloading unit 19, reached by the trays loaded with the tubes free of spinning residues. In this station the tubes are removed from the peg on the tray, and normally returned to the spinning process. Downstream of the unit 19 the unloaded and available trays P are routed to the spool-feeding path 3 to receive a new winding spool in the loading unit 11.

Each of the spooling and auxiliary operations requires its own processing time. The need for limiting the dead moments requires at any rate a certain stock of "stand-by" trays for every processing stage. It must further be taken into account that a small yet significant part or the spools may require to be set aside for the operators' intervention purposes.

The required stock of trays for each spooling unit 5 constituting an automatic spooler of a recent design may vary from 4 to 8 trays available on the spooling machine: this means that a few hundred trays are simultaneously available arid circulating on the spooler. If the spooler is directly connected to the spinning machines to form the so-called spinning and spooling machine, the overall number of trays fitted to the machine rises to even larger numbers.

This considerable number of tubes and spools circulating each on a tray P takes up considerable space, which does not cause difficulties during the spooler's normal operation, but may be a source of considerable problems in the initial and final batching stages, especially if several batches are processed simultaneously, as well as when any malfunctions of the units in the setting-up section 2 adjacent to the spooling section 1 occur, at least during the operators' time-out for intervention.

At the start of a batch, for example, all the trays with an exhausted tube of the previous batch must generally be arranged on a return path 4, followed by the removal of the tubes of the previous batch from the tray by using the spools of the new batch, and their setting up and forwarding to the feeding circuit 7. The spooling is preferably started only when the return path 4 is freely available to unload the trays from the spooling units.

The so-called "batch endings" may be due to both a decision to simply break off the processing of the existing batch to make room for a different batch, an exhaustion of the batch, or a so-called optimized exhaustion, which at the time of exhausting the batch concentrates the residual yarn on completing the maximum possible number of spools, while gradually deactivating the units completing a spool, and preferentially feeding the still available spools to the units awaiting completion of their spools. These various "batch endings" are handled in different ways; in any case, their handling requires accumulating the trays on the return path 4 before starting a new batch. The accumulation of trays on "stand-by" duty causes a crowding of the paths, with resulting difficulties and delays in the transition stage. For example, if a queue is created on path 4, the same is indifferently constituted by the transport of spools A to be recycled, by soiled tubes C and clean tubes B, and if even a single of the service units specifically dedicated to them is deactivated, all trays must stop. If the queue of the trays stopped on path 4 lengthens to the point of obstructing the outgoing spooling units 5, beginning from those closest to section 2 i.e. those at the extreme right of FIG. 1, these units will progressively be blocked and become unable to perform their work.

The purpose of this invention is to improve the moving of the trays in the spooling unit 1 to prevent the problems hereto described, and is in its broadest sense defined in claim 1, while its preferential embodiments are defined in the subordinate claims. In order to better evidence the characteristics and advantages of this invention, the same will now be described with reference to a typical embodiment, as shown for exemplifying and non-limiting purposes in the FIGS. from 2 to 4.

At the outlet of the paths 6 inside the spooling units 5 of section 1, the direction of the trays is skewed in a sense opposite to the direction of the return path 4, with the outlet passages 21 determined by tray-orienting guides. The passages 21 join each other at a path 22 which extends all the way along the face of the spooling section 1 connecting the passages, and which is in turn formed by some laterally orienting guides. A conveyor belt 23 of appropriate width is arranged under the passages 21 and the path 22, and moves the trays which are unloaded from the spooling units to the left, meaning in a direction opposite to that of the return path 4.

At the end of the spooling units' face, the path 22 is inverted by a U-shaped turn 24, switching it around 180° by its guides and moving the trays along a path 25, which is in itself determined by laterally orienting guides and runs in the same direction as that of the path 4.

A conveying belt or strap system 26 is arranged under the paths 4 and 25, so as to move the trays resting on the same. The return path is therefore a sequence of the paths 22, 25 and 4. The length of the additional paths 22 and 25 allows accumulating the spooler's entire normal stock of trays, while at any rate preventing the obstruction of the spooler units' outlets. The operations to start and end the spinning batches are thus facilitated or speeded up. The density of the trays present in the overall return path may vary depending on the requirements and circumstances.

At the end of the path 25, before it joins with the path 4, a switch 30 is applied by a U-shaped inversion of the motion and by using means similar to those of the curve 24, so as to return the trays deviated by the switch 30 back to the belt of the path 22 facing the outlets of the spooling stations 5.

A switching organ 29 is positioned ahead of the U-shaped switch 30 and actuated whenever the trays with their spools or tubes must not be allowed to continue toward the path 4. In this case the trays are caused to circulate on the circuit of the paths constituted by the sections 22–25 joined to each other by the curves 24–30, while awaiting to be unblocked toward the path 4 of the setting-up section 2. The circumstances keeping these trays in a circulating motion prevent a permanent clogging even in the presence of a considerable queue of stand-by trays, and keep the outlets of the spooling units free even during the blocked periods of path 4.

Figure 3:
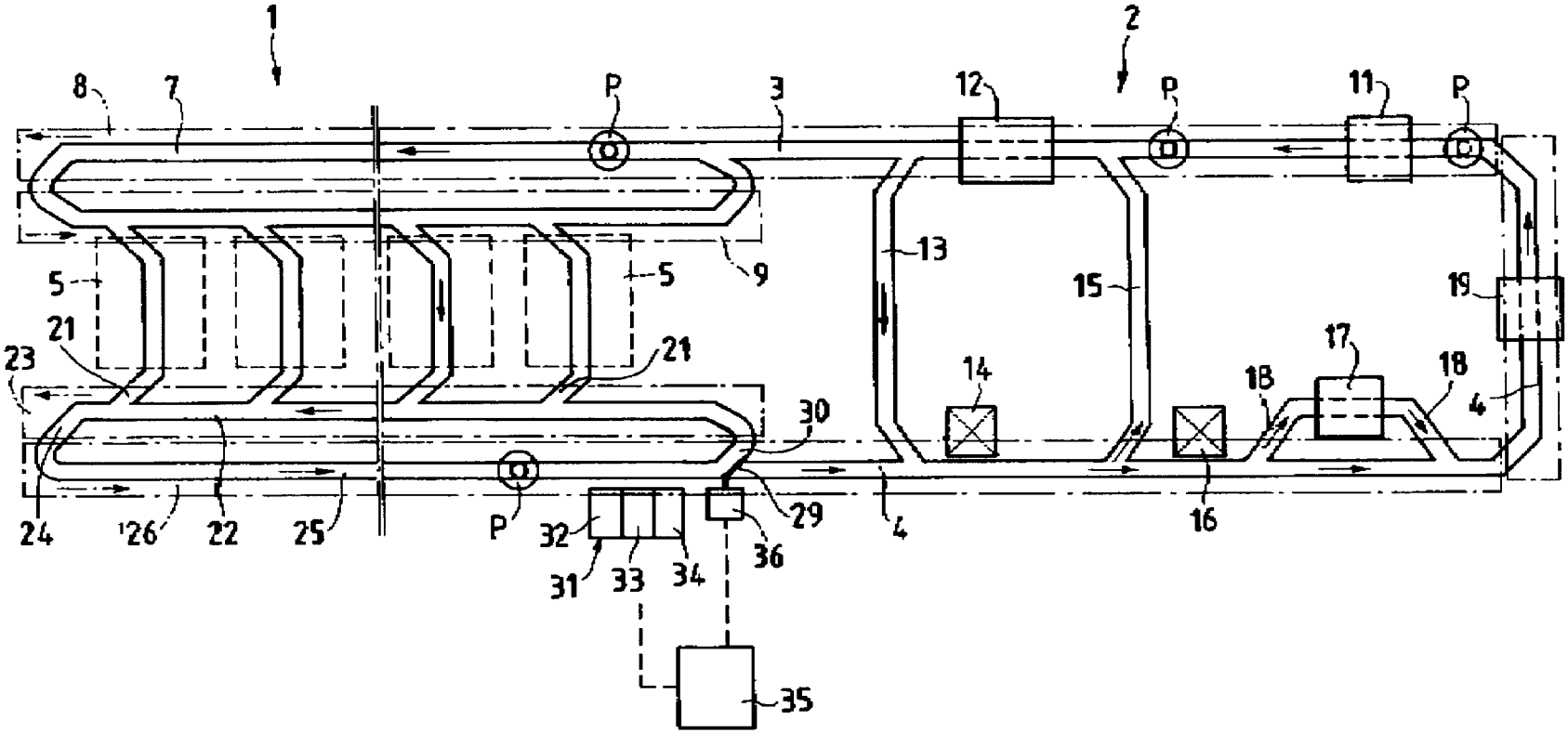
FIG. 3 depicts the layout of a spooling machine according to an embodiment of the present invention.

A preferred embodiment of the invention is now described with reference to FIG. 3, again for exemplifying and non-limiting purposes. This figure schematically describes the actuating of the transport, on the paths 3 and 4, by using underlying conveyor belts of a conventional type, where the direction of the path is determined by overlaying guides whose distance from each other is little more than that of the tray's collar.

A spool and tray identifying station similar to those on the return path 4 is placed on the path 25 prior to tile deviation 30. In particular, the identifying station 31 is preferentially constituted by a tray identifying station 32 designed to recognize its type of spool, essentially used where several batches of yarn are to be processed simultaneously, by a spool-sensing station 33 designed to identify the trays carrying the spools A to be recycled to the setting-up station 12 and thus to be returned to the spooling units, and by a sensing station 34 designed to identify the trays carrying the soiled tubes c to be cleaned in the station 17, while distinguishing them from the trays carrying clean tubes meant to be simply removed from their trays in the station 19.

A switching organ 36, entirely similar to the formerly described switch 29, is positioned downstream of the identifying station 31. Based on the identifications made by the station 31 and the commands of the spooler's control unit, as symbolically indicated in the figure by the numeral 35, this switch determines the path of every tray P depending on the requirements and the type of spool or tube it is carrying.

In other words, the identifying station 31 is connected to said control unit, which based on the identifications performed on a tray-by-tray basis by this identifying station 31 selectively commands the switch 31 to determine the path of every tray, depending on the circumstances.

Under fully operating conditions the spooler releases the trays from the spooling units on path 22 to the left up to the U-shaped turn 24, and these continue moving to the right on the paths 25 and 4, without necessarily being identified in the station 31, nor deviated by the switch 36.

The spooler components according to this invention are caused to act during the machine's transitional operating phases, both at the beginning or at the end of a batch as well as during any malfunction or periods of intervention on parts of the spooler. As an example, if the batch is in its final phases and only a single batch is being processed on the entire spooling machine, the identification of the spools A in the station 33 may be carried out as follows: only the trays carrying the spools A are not stopped and allowed to continue toward the identifying and switching station 14 for the spools A to be recycled to their setting-up in station 12, so as to be subsequently exhausted in their spooling units. On the other hand, the trays carrying clean tubes B or soiled tubes C are switched on the curve 30 so as to circulate on the so-called "stand-by" circuit, meaning a parking circuit for the trays circulating in the sections 22–24–25–30, while awaiting a chance to change the batch, thus gradually liberating the machine of the spools being exhausted. The same set-up may be adopted whenever a malfunction or an intervention occurs in the tray unloading station 19.

On the other hand, if several batches are processed simultaneously and one of the batches is approaching its terminal phase, this interception and selection is also carried out by activating the batch identifying station 32 and implementing the circulating storage on said circuit only for the clean tubes B and soiled tubes C of the batch being exhausted, while on the other hand allowing the trays of the other batch to circulate undisturbed.

Again for exemplifying purposes, if the tray selecting station 14 is not properly operating and thus incapable of correctly identifying and determining the switching of the trays using the spools A and an operation for its adjustment is underway, the station 33 is activated for the purpose of identifying the spools A on the path 25, so as to switch its trays and cause them to circulate in a "stand-by" mode, until station 14 is put back in operation, while on the other hand the trays carrying the tubes B and C are allowed to continue undisturbed.

If any disturbances occur or interventions are underway in the tube cleaning station 17, the tubes of type C, i.e. the soiled tubes can be identified. The station 34 is then activated in order to identify the tubes C on the path 25, to switch their trays and cause them to circulate in a "stand-by" mode, until the station 17 is taken back into operation, while on the other hand the trays with the cleaned tubes B an the spools A are allowed to continue undisturbed.

Figure 4:
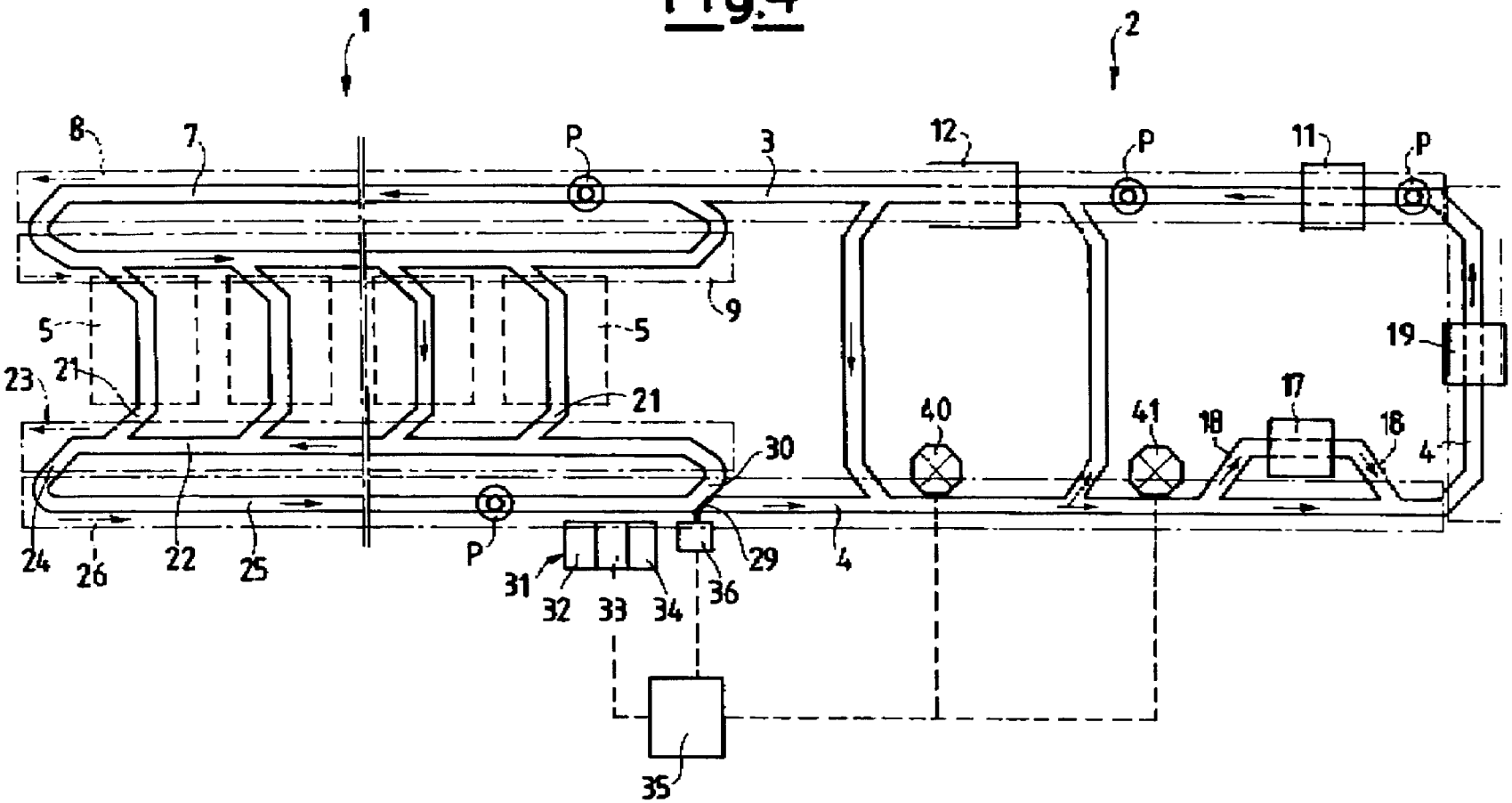
FIG. 4 depicts the layout of a spooling machine according to an embodiment of the present invention, where an identifying station is kept in continuous operation.

According to a farther embodiment of this invention shown in a simplified form in FIG. 4, the identifying station 31 is kept in continuous operation to identify all the spools or tubes reaching the path 25, even under full operating conditions in lieu of the stations 14 and 16. In this embodiment, in station 31 each tray P is identified by a recorded code and checked on whether it carries a spool A or a tube B or C for example based on a handling and coded recording system as described in the European patent application no. 796,812 in the name of the same applicant. The subsequent switching stations of section 2 are already capable of operating based on this identification. The station 40, taken in lieu of the selecting station 14, limits itself to identifying the passing tray P, and communicating its recorded code to the control unit 35, which based on the information received from station 31, identifies the spools of type A carried, and thus switches them on their trays P to path 15. A similar communication to the control unit 35 occurs for the trays P carrying spools on the path 13, on the part of the control unit placed at the outlet of the setting-up unit 12. If the control reveals the presence of an improperly set-up spool, its tray P is identified—this recorded identification is communicated to tie control unit 35—and then switched to the recycling path 13.

Even the station 41, taken in lieu of the selecting station 16, limits itself to identifying the passing tray p and to communicating its recorded code to the control unit 35, which based on the information received from the station 31, identifies the trays p carrying tubes of type c and switches them toward the unit 17 to clean the tubes.

What is claimed is:

1. A system for moving spools or tubes of an automatic spooler circulating spools or tubes on transport trays comprising:

a spooling section;

a setting-up section;

wherein the setting-up section and spooling section are essentially connected by a first path and a second path for the feeding and unloading, respectively, of trays; and a feeding circuit providing a plurality of spools ready to be unraveled to a plurality of spooling units lined up along a front and fed by spools ready to be unraveled, by using a feeding circuit;

wherein the setting-up section includes a set of spool loading units loading unloaded trays; a set of spool setting-up units feeding the feeding circuit; a first selecting station along the second path capable of identifying spools to be recycled and causing the spools to be switched to a third path leading toward the setting-up units; a second selecting station capable of identifying tubes soiled by residual yarn and of causing the soiled tubes to be switched toward a cleaning unit on a fourth path, and an unloading station for unloading tubes;

wherein the unloading station releases trays routed to the first path;

wherein the spooling units of the spooling section are at their outlets connected by passages to an unloading circuit comprising in sequence a fifth path extending over the full length of the spooling section, a U-shaped curve, a sixth path in a reverse direction essentially parallel to the fifth path and, set at the end of the sixth path, before joining up with the second path, a U-shaped switch connecting the fifth path and the sixth path, where said unloading circuit is fitted with a switching device which depending on a set of commands allows trays to be moved forward on the second path or prevents trays along with spools or tubes from circulating on said unloading circuit.

2. The system for moving the spools and tubes of an automatic spooler according to claim 1, wherein a spool or tube identifying station is placed on the sixth path of the unloading circuit and ahead of the switching device, wherein the switching organ causes the forwarding of trays with spools and tubes along the second path or their return toward the fifth path comprising the U-shaped switch.

3. The system for moving the spools and tubes of an automatic spooler according to claim 2, wherein the identifying station comprises a batch identifying station identifying the spool carried by each tray, by identifying the tray itself.

4. The system for moving spools and tubes of an automatic spooler according to claim 2, wherein the identifying station comprises a spool sensing station to identify trays carrying any spools to be recycled to the setting up units and a spool sensing station to identify trays carrying soiled tubes to be cleaned in the cleaning unit, so as to distinguish trays carrying soiled tubes from trays carrying cleaned tubes.

5. The system for moving the spools and tubes of an automatic spooler according to claim 2, characterized in that the identifying station is connected to a spooler control unit, wherein the spooler control unit, based on the identifications received tray by tray from said identifying station, commands the switching device to determine the path of every tray depending on the circumstances.

6. The system for moving the spools and tubes of an automatic spooler according to claim 5, characterized in that the first selecting station and the second selecting station identify trays in a coded record and communicate said identification to the spooler control unit, and wherein the spooler control unit, based on the identifications from the identifying station, determines by the switches of said first and second selecting stations the switching direction so that trays carrying the spools to be recycled are switched on the third path and trays carrying tubes soiled by residual yarn are switched on the fourth path.

* * * * *